US007618013B2

(12) United States Patent
Elmer et al.

(10) Patent No.: US 7,618,013 B2
(45) Date of Patent: Nov. 17, 2009

(54) MAGNETIC ASSEMBLY AND METHOD

(76) Inventors: William A. Elmer, 1010 Temple Grove, Winter Park, FL (US) 32789; Steven W. Elmer, 1351 Oneco Ave., Winter Park, FL (US) 32789

( * ) Notice: Subject to any disclaimer, the term of this patent is extended or adjusted under 35 U.S.C. 154(b) by 613 days.

(21) Appl. No.: 11/034,197

(22) Filed: Jan. 12, 2005

(65) Prior Publication Data

US 2005/0178033 A1 Aug. 18, 2005

Related U.S. Application Data

(60) Provisional application No. 60/536,303, filed on Jan. 14, 2004.

(51) Int. Cl.
*A47G 1/17* (2006.01)

(52) U.S. Cl. ..... 248/309.4; 248/206.5; 40/600

(58) Field of Classification Search ..... 248/683, 248/206.5, 467, 309.4; 40/124.04, 661.01, 40/600, 711

See application file for complete search history.

(56) References Cited

U.S. PATENT DOCUMENTS 3,082,982 A * 3/1963 Moskowitz ..... 248/537
4,226,669 A * 10/1980 Vilardi ..... 159/6.1
4,646,873 A * 3/1987 Bryson ..... 181/160
5,932,942 A * 8/1999 Patyk et al. ..... 310/58
6,491,271 B1 * 12/2002 Adams ..... 248/206.5
6,496,588 B1 * 12/2002 Chang ..... 381/358
6,729,591 B2 * 5/2004 Hsu ..... 248/205.6
6,739,567 B1 * 5/2004 Curtis ..... 248/548
6,762,527 B1 * 7/2004 Horng ..... 310/156.18
2006/0000130 A1 * 1/2006 Gajdacs ..... 40/600

* cited by examiner

*Primary Examiner*—A. Joseph Wujciak, III
(74) *Attorney, Agent, or Firm*—Allen Dyer Doppelt Milbrath & Gilchrist

(57) ABSTRACT

A magnetic mounting assembly includes a plate carried within the housing. The plate has a central opening and multiple apertures offset from the central opening with a permanent magnet carried within each of the apertures. A cover is compression fit with the housing for securing each magnet between inside surfaces of the cover and the housing, and within the aperture. A central opening is formed with the housing, the cover, and the plate for receiving a fastener when fastening the assembly to an object.

18 Claims, 5 Drawing Sheets

MAGNETIC ASSEMBLY AND METHOD

CROSS-REFERENCE TO RELATED APPLICATIONS

This application claims the benefit of U.S. Provisional Application No. 60/536,303, filed Jan. 14, 2004 for "Magnet Housing Assembly and Method," the disclosure of which is hereby incorporated herein in its entirety by reference.

FIELD OF INVENTION

The present invention pertains to a magnet housing assembly and method of construction.

BACKGROUND

Magnet housing assemblies are particularly desirable for use with magnetic advertising signs used on automotive vehicles. Because the magnets must withstand forces occurring during the vehicle's motion without becoming dislodged, high strength is necessary; however, when the signs are used as temporary fixtures, magnet strength must not be so high as to defeat removal. Therefore for certain applications, it is desirable to use a plurality of smaller magnets arranged in a permanent fashion inside a housing, so that the magnetic force is distributed across the housing's surface area.

To assure that the magnets do not shift during construction of the assembly and during use, it is necessary to permanently fix the magnets in place. Although glue is used as one method to fix magnets in place, the glue must be able to withstand the temperatures to which the finished housing will be subjected for applying a coating, such as polyolefin or a similar coating material to be applied. Such coatings, regardless of the method of application, are applied at temperatures in the range of 400 to 500 degrees Fahrenheit, and thus, require the use of high temperature glue to assure the magnet remains attached to the housing during and after manufacturing. Use of high temperature glue is relatively expensive as well as unnecessary for the routine use of the magnet. In order to avoid these problems alternate solutions are desirable.

SUMMARY

A magnet assembly according to the teachings of the present invention may comprise a housing having a bottom wall and an upstanding sidewall forming a cavity therefor. A plate is carried within the cavity and includes a plurality of apertures therein. Permanent magnets are positioned within each of the plurality of apertures. A cover having a top wall and a downwardly sidewall makes frictional contact with the upstanding sidewall of the housing for securing the cover to the housing. As a result, transverse movement of each magnet is limited by placement of the magnet within the aperture and longitudinal movement limited by the opposing inside surfaces of the cover and housing bottom walls.

The housing, the plate, and the cover each may include a central opening for receiving a fastener therethrough when fastening the mounting assembly to an object, and wherein each of the plurality of apertures within the plate is offset from the central opening. Optionally, the housing and cover may be cylindrical in shape. A plastic coating may substantially covering the housing and cover outside surfaces.

With regard to the plate, at least a portion of the plate may be in a spaced relation to the bottom wall of the housing. The plate may comprise an arcuate shape for permitting a peripheral portion to contact the housing bottom wall while having an intermediate portion including the plurality of apertures spaced from the bottom wall. Tabs may be carried by the housing, cover, or plate. The tabs may extend from a peripheral portion of the plate for making frictional contact with at least one of the cover and the housing sidewall for providing a compression-fit therebetween.

A central portion of the cover may include a depression with a portion of the depression contacting or at least proximate the bottom wall of the housing when the cover is secured thereto. One embodiment may include the cover secured within the housing through frictional contact between a cooperating outer surface of the downwardly sidewall of the cover and an inner surface of the upstanding wall of the housing. The magnets may have varying cross-sections and shapes with the aperture shaped accordingly to accommodate the shape of the magnet.

An embodiment of the invention may also be described, by way of example, in an apparatus and method for containing one or more magnets that may be used as a means for removably attaching an object to a finished metal surface using a plurality of magnets held in a magnet housing assembly. A magnet housing may be made from a metal or from any other suitable material, and be described to include a bottom portion, a top portion and an insert template or plate. The insert template may have one or more apertures that allow non-magnetized elements to be secured in a fixed position without glue. The insert template is placed inside the bottom portion and the magnetic elements are introduced into the apertures in the insert template. The top portion or cover is then fitted between the inside wall of the bottom portion and the insert. The completed housing assembly may be dipped or sprayed using an appropriate coating for the application for which the magnets are required. Once the coating dries, the housing assembly is subjected to a magnetic field, by way of example, for causing the non-magnetized elements to become magnetized for use as permanent magnets in a contemplated application.

A method aspect of the invention includes assembling plural magnets for attaching an object to a metallic surface. The method may comprise providing a housing having a bottom wall and an upstanding sidewall forming a cavity therein, inserting a plate within the cavity, the plate having a plurality of apertures therein, placing a magnetic substrate within each of the plurality of apertures, securing a cover to the housing for providing an assembly, the cover having a bottom wall and a downwardly sidewall, the downwardly sidewall making frictional contact with the upstanding sidewall of the housing for securing the cover thereto, wherein transverse movement of each magnet is limited by placement of the magnet within the aperture and longitudinal movement limited by the opposing inside surfaces of the cover and housing bottom walls, and exposing the coated assembly to a field for magnetizing the magnetic substrate so as to form a permanent magnet. The method may further comprise coating the assembly with a plastic material.

BRIEF DESCRIPTION OF THE DRAWINGS

Embodiments of the invention are described by way of example with reference to the accompanying drawings in which.

DETAILED DESCRIPTION OF EMBODIMENTS

The present invention will now be described more fully with reference to the accompanying drawings in which alternate embodiments of the invention are shown and described. It is to be understood that the invention may be embodied in many different forms and should not be construed as limited to the illustrated embodiments set forth herein. Rather, these embodiments are provided so that this disclosure may be thorough and complete, and will convey the scope of the invention to those skilled in the art.

Figure 1:
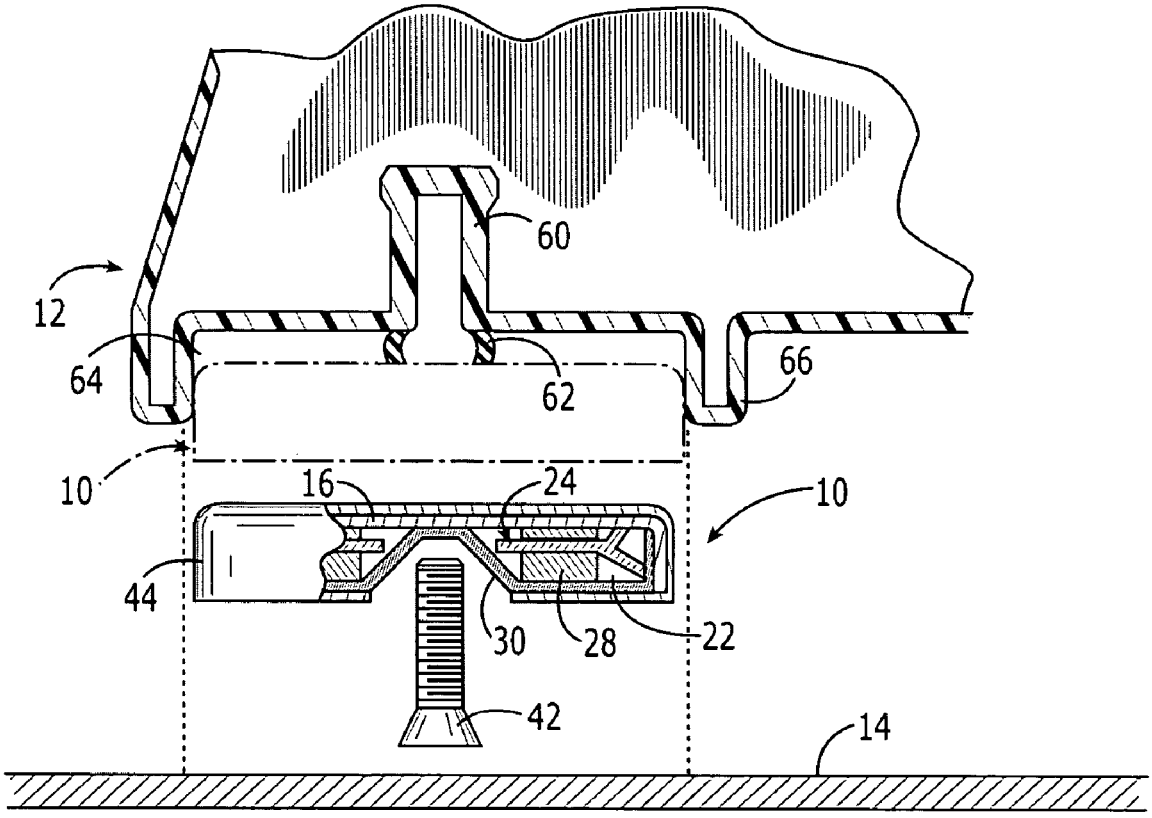
FIG. 1 is a partially exploded view of an example of one contemplated use of an embodiment of the present invention illustrating a cross-sectional view of one mounting assembly attached to an advertising sign.
Figure 2:
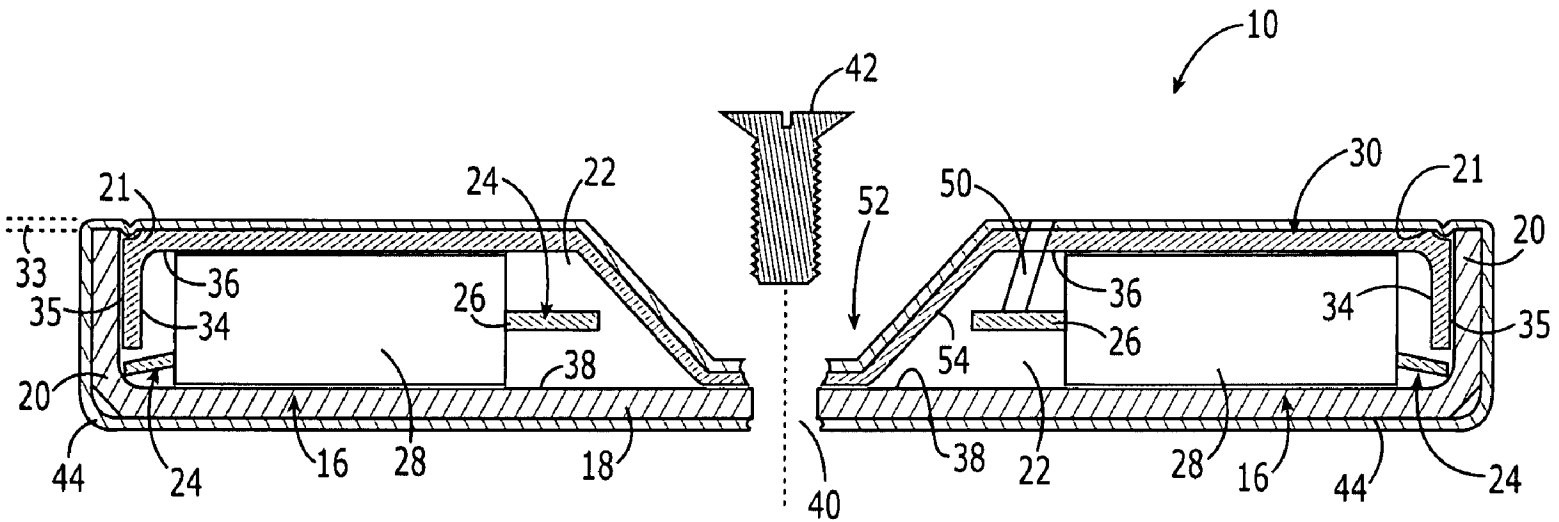
FIG. 2 is a cross-sectional view of a magnet assembly constructed in accordance with the present invention.
Figure 2A:
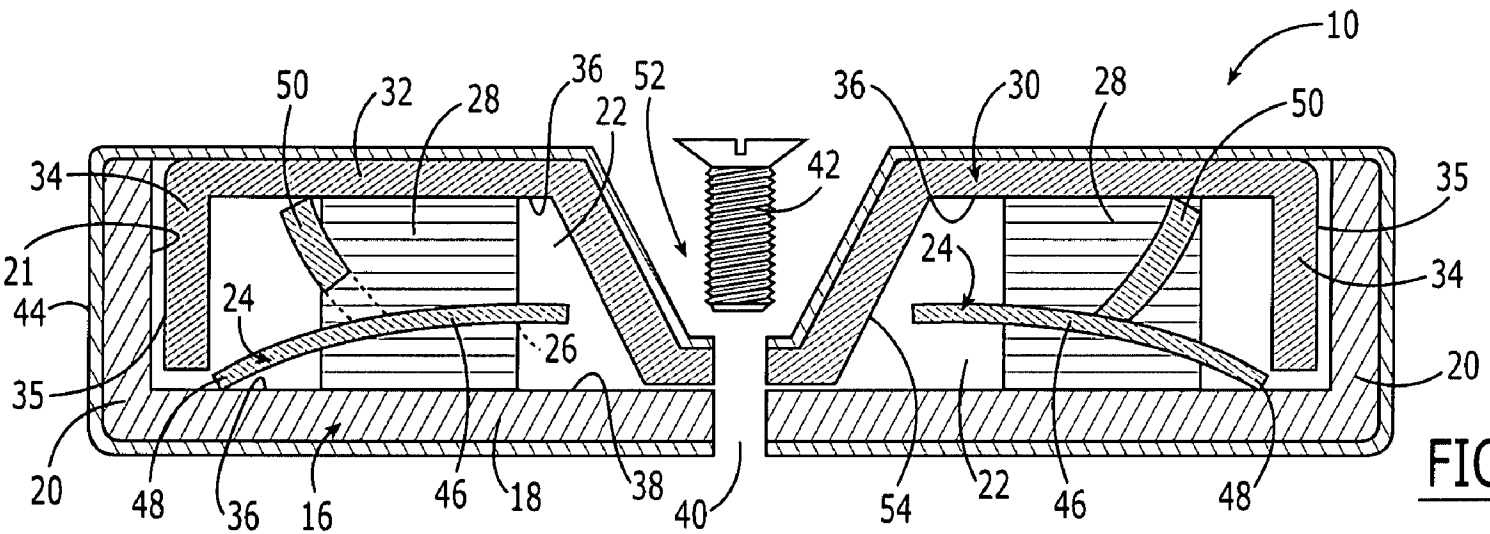
FIG. 2*a* is a cross-sectional view of a magnet assembly constructed in accordance with the present invention while illustrating an alternate configuration and dimension of components thereof.

With reference initially to FIG. 1, one embodiment of the invention herein described, by way of example, is a mounting assembly 10 useful in attaching a sign 12 to a metallic structure 14, such as that found on a motor vehicle used in transporting an advertising sign. With reference to FIGS. 2 and 2*a*, the mounting assembly 10 includes a housing having a bottom wall 18 and an upstanding sidewall 20 forming a cavity 22 within the housing. A template or as herein described, a plate 24 is carried within the cavity 22 and includes a plurality of apertures 26. Permanent magnets 28 are positioned within each of the plurality of apertures 26. As will later be later described in this section, non-magnetized elements, yet a magnetic substrate or material, capable of being magnetized, may be placed within the apertures for subsequent electromagnetic field exposure. Such provides for ease in assembling the mounting assembly without having to deal with the magnetic forces. A cover 30 having a bottom wall 32 and a downwardly sidewall 34 makes frictional contact with the upstanding sidewall 20 of the housing 16 for securing the cover to the housing. As a result, transverse movement of each magnet 28 is limited by placement of magnets within the apertures 26 and longitudinal movement is limited by the opposing inside surfaces 36, 38 of the housing and cover bottom walls 18, 32. Further, and as illustrated by way of example with reference to FIG. 2, one embodiment includes the cover downwardly sidewall 34 having a length dimension such that a recess 33 is formed when the cover 30 is fully engaged within the cavity 22 as a result of a longer length dimension for the housing upstanding wall 20.

The housing 16, the plate 24, and the cover 30 each include a central opening 40 cooperating for receiving a fastener 42 therethrough, such as the screw illustrated by way of example with reference again to FIGS. 1 and 2, when fastening the mounting assembly 10 to an object such as the sign 12. For the embodiment herein described by way of example, each aperture 26 within the plate 24 is offset from the central opening 40 of the plate. Optionally, and as herein described by way of example, the housing 16 and the cover 30 may be cylindrical in shape. Further, a plastic coating 44 may cover the assembly 10.

With reference to FIGS. 3*a*-3*e* and 4*a*-4*c*, at least an intermediate portion 46 of the plate 24 may be in a spaced relation to the bottom wall 18 of the housing 16. As herein illustrated by way of example, the plate 24 may comprise an arcuate shape for permitting a peripheral portion 48 to contact the housing bottom wall 18, as illustrated with reference again to FIGS. 2 and 2*a*, while having the intermediate portion 46 including the plurality of apertures 26 spaced from the bottom wall 18. The plate 48 may carry crimps or tabs 50. The tabs 50 may extend from the peripheral portion 48 of the plate 48 for making frictional contact with the cover downwardly sidewall for providing a comparison-fit between cover and housing sidewalls. A central portion 52 of the cover 30 may include a depression 54 with a portion 56 of the depression contacting or at least proximate the bottom wall 18 of the housing 16 when the cover 30 is secured thereto, as illustrated with reference to FIG. 4*c*, by way of example. As herein described, by way of example, one embodiment may include the cover 30 secured within the housing 16 through frictional contact between a cooperating outer surface 35 of the downwardly sidewall 34 of the cover and an inner surface 21 of the upstanding wall 20 of the housing 16. As later described in this section, the magnets 28 may have varying cross-sections and shapes with the aperture 26 shaped accordingly to accommodate the shape of the magnet, as illustrated with reference again to FIGS. 2 and 2*a*. As further illustrated with reference to FIGS. 2 and 2*a*, the plate peripheral portion 48 may fit under or inside the cover sidewall 34.

By way of further detail, and with reference again to FIGS. 2, 2*a*, and 3*a*-3*e*, the mounting assembly 10 includes a convex shaped plate 24. The depression 54 is slightly deeper than the height of the sidewall 34 with an inner surface 33 of the cover bottom wall 32 resting on the inside surface 21 of the housing bottom wall 18.

The plate 24, an insert template has a plurality of apertures 26 having a similar shape as the magnet 28 but fractionally larger in dimension than the corresponding magnet. When a magnet 28 is inserted in the aperture 26, the convex plate 24 rests with its outer circumference touching the inside surface 21 of the housing upstanding wall 20. The housing 16 thus holds the plate 24 in place and provides a structural framework for the assembly 10. The cover 30 is then inserted into the housing 16 so that the cover outer surface 35 extends along the inner surface 21 of the sidewall 20. The tabs 50, as illustrated again by way of example in FIGS. 4*a*-4*c* engage an inside surface of the cover bottom wall 32 to permit a compression fit, and hold the plate 24 and thus the magnets 28 in a desired position, or non-magnetized elements in place until they are subjected to a magnetizing step, as described in greater detail below.

When fully assembled, only an outside surface of the cover bottom wall 32, an outside surface of the housing bottom wall 18, and a circumferential outside surface of the housing upstanding sidewall 20 are exposed. Then the coating 44, such as polyolefin or another similar polymeric coating depending on the contemplated application may be applied to the fabricated assembly 10. The completed assembly 10 may then be subjected to a magnetic field, which activates the magnets 28.

Figure 3A:
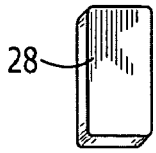
FIG. 3*a* is a top perspective view of one magnet having a rectangular cross section.
Figure 3B:
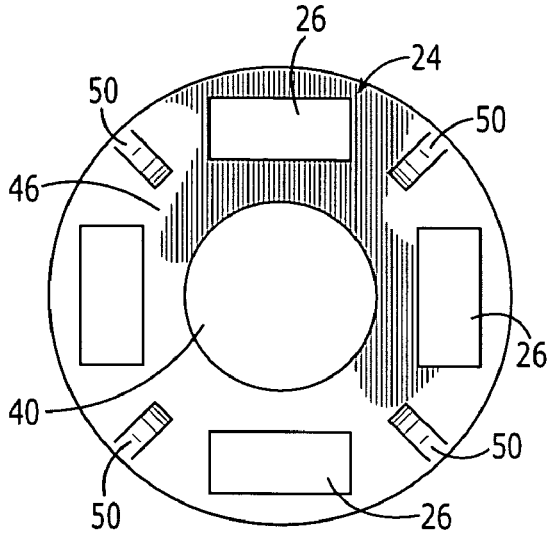
FIGS. 3*b*-3*d* are top views illustrating individual components of magnet assembly of FIG. 2 including, a plate, a cover, and a housing, respectively.
Figure 3C:
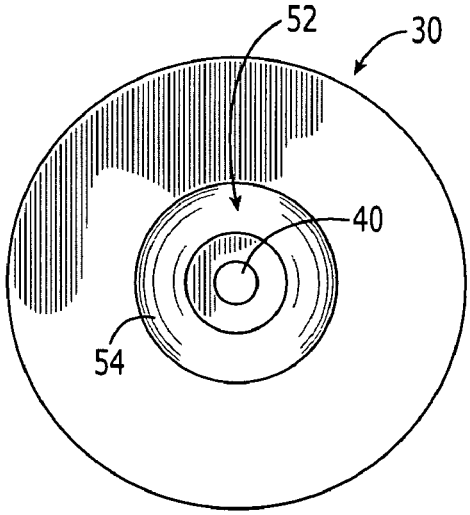
Figure 3D:
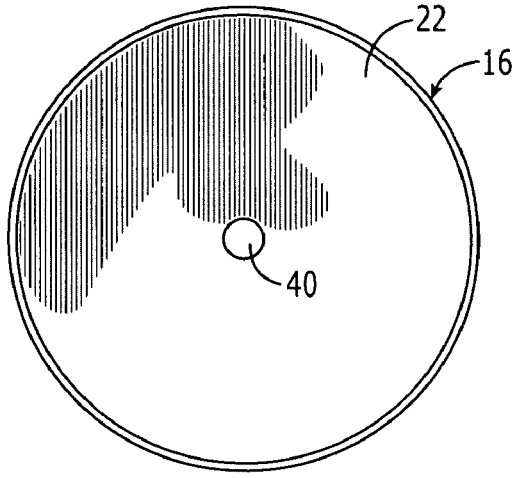
Figure 3E:
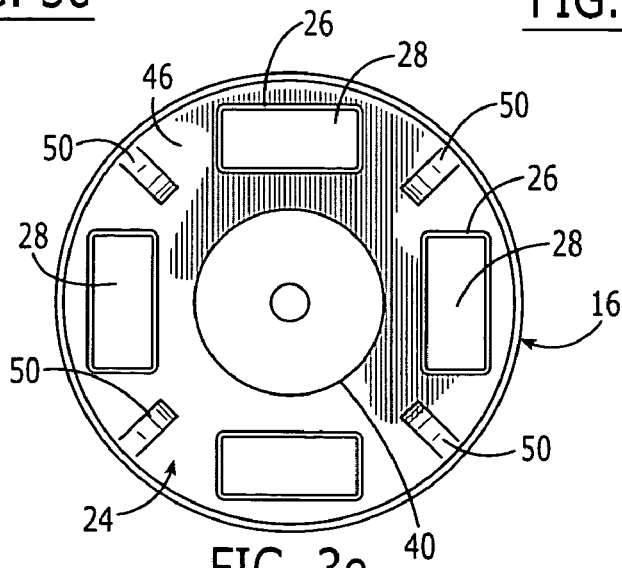
FIG. 3*e* is a top view of partially assembled components less the cover for illustrating by way of example, one arrangement thereof in accordance with the teachings of the present invention.

FIG. 3*a* illustrates an individual polygonal-shaped magnet 28, such as may be used in a completed assembly 10. A person skilled in the art will recognize that magnets come in a number of shapes including toroidal, semi-toroidal as well as various polygonal shapes, and irregular shapes and circles. The shape shown is illustrative of these possibilities. FIG. 3*b* illustrates the plate 24. The plate 24 may be a flat, circular plate, made of a metal or other heat resistant material, into which the plurality of apertures 26 for holding the magnets 28 are made available. In one embodiment, a plurality of the crimps or tabs 50 are raised above the surface 11 of the plate 24 to form a compression fit when the plate 24 is placed into the bottom portion 40, with the crimps 50 facing and covered by the top cover 30.

As herein described, by way of example, the cover 30 is made from stainless steel or another non-magnetic material and is formed as a circular disk having the sidewall 34 and an outside diameter slightly smaller than the inside diameter of the housing 16, as illustrated with reference again to FIGS. 3*c*-3*e*. When assembled, the depression 54 passes through the central opening 40 of the plate 24, to rest against the inside surface of the housing bottom wall 18. Providing the cover 30 with a slightly smaller diameter and circumference relative to the housing 16 allows for a snug fit between these two parts.

With reference again to FIGS. 2, 2*a*, and 3*d*, the housing 16 for the embodiments, herein described by way of example, is a circular disk shape made of stainless steel or other metal with its circumferential sidewall 20 extending to the full height of a completed assembly 50 before application of the coating 44. In the completed assembly 10, the magnets 28, the plate 24, and the cover 30 are carried and fit within the cavity 22 of the housing 16.

Figure 4A:
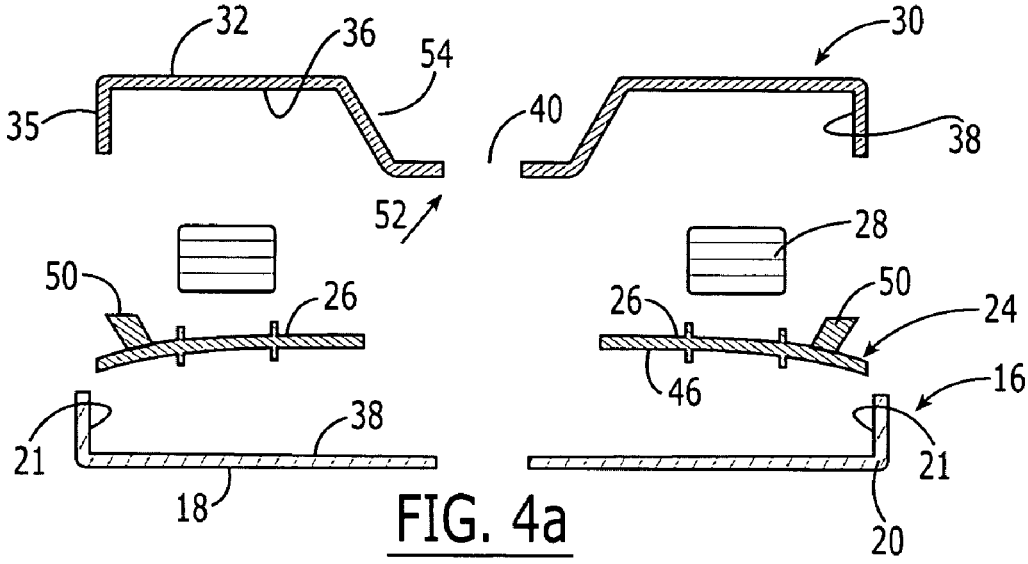
FIGS. 4*a*-4*c* are sequential cross-sectional views illustrating one method of assembling the components of FIG. 4*a*-4*d;*
Figure 4B:
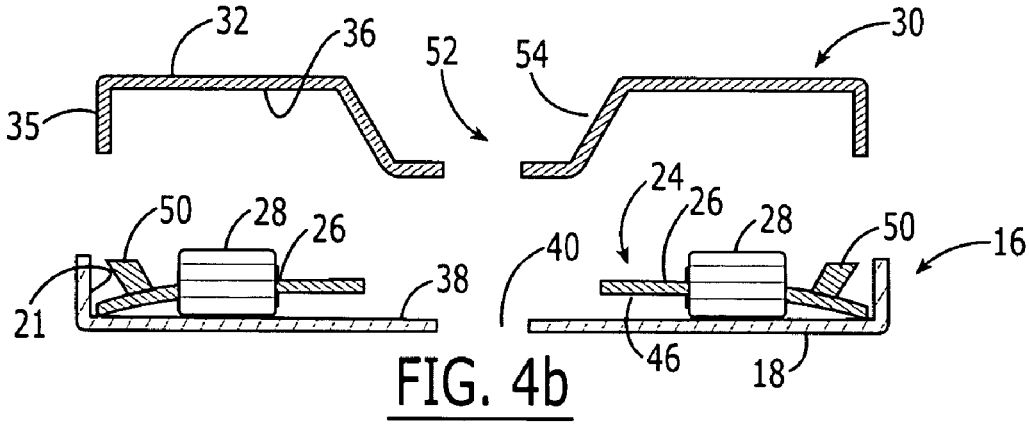
Figure 4C:
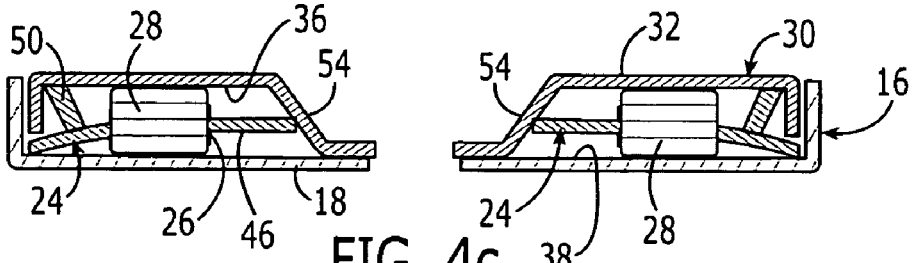

With regard to a method of assembling, reference is again made to FIGS. 4*a*-4*c*. In FIG. 4*a*, Step 1, the magnets 28, the plate 24, the cover 30, and the housing 16 are collected and oriented as illustrated. In this illustration, the plate 24 is shown with the tabs 50 facing the inside surface of the cover 30. It will come to the mind of those skilled in the art that alternate arrangements are available without departing from the teachings of the present invention. As illustrated in FIG. 4*b*, Step 2, the plate 24 is placed inside the cavity 22. Magnets 28, or a substrate capable of being magnetized, are then inserted in each of the apertures 26, and with the bottom surface of each magnet resting on the inside surface of the housing bottom wall 18. In a next step, Step 3, illustrated with reference again to FIG. 4*c*, the cover 30 is inserted into the housing 16 in which the plate 24 and the magnets 28 have previously been placed. The concave circular depression 54 of the cover 30 passes through the central opening 40 of the plate 24 and rests on the inside surface the housing bottom wall 18. Pressure is then placed on the outside surfaces of the housing and cover bottom walls 18, 32 so as to engage the tabs 50 against the inside surface of the cover 30 to form a compression fit.

Figure 5A:
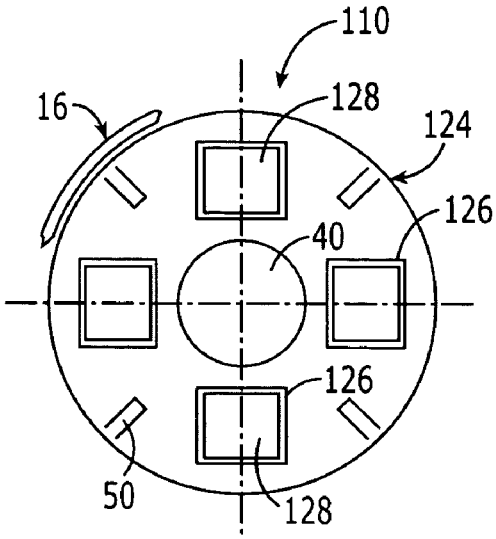
FIGS. 5*a* and 5*b* depict alternative configurations of the present invention.
Figure 5B:
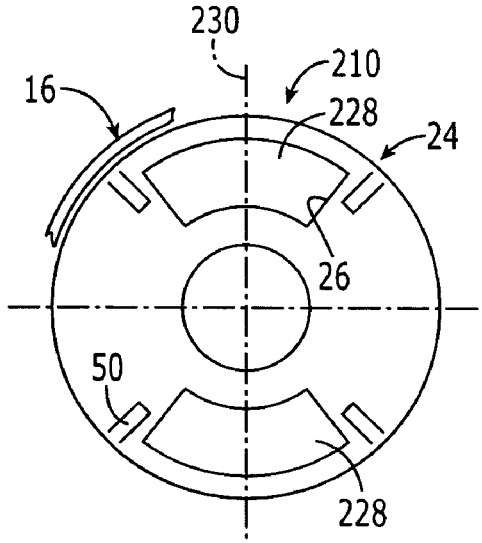

Alternative embodiments are presented with reference to FIGS. 5*a*-5*c*. In FIG. 5*a*, an assembly 110 includes four square shaped magnets 128 instead of the four rectangular shaped magnets 248, earlier described. The magnets 128 are arranged at right angles to axes 112 each of which intersects opposing individual magnets. The apertures 126 in the plate 124 are modified in shape to accommodate the change in magnet dimensions. This arrangement is useful when magnetic force must be evenly distributed across the surface of the assembly 110.

FIG. 5*b* illustrates an inside view of an alternate assembly 210 having two semi toroidal-shaped magnets 228 arranged along an axis of orientation 230 so that the center of one magnet 228 is located 180-degrees from the center of a second opposing magnet 229. Four crimps or tabs 250 are located on the surface of plate 24 and are oriented at right angles with respect to a second set of axes 231. As earlier described, the apertures 26 are modified in shape to accommodate the semi-toroidal magnets.

Figure 6A:
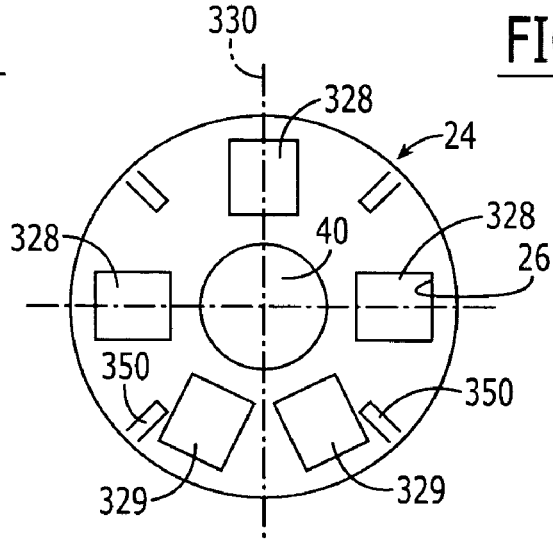
FIGS. 6*a*-6*c* depict alternative arrangements of magnets positioned within a plate of a mounting assembly, by way of example.
Figure 6B:
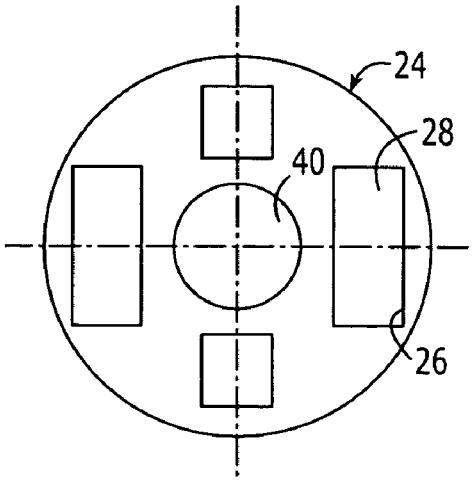
Figure 6C:
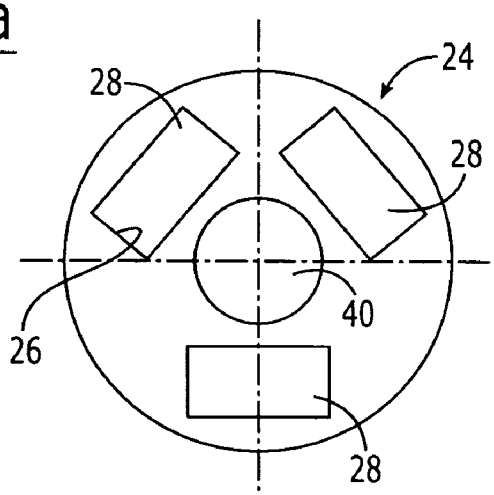

FIGS. 6*a*-6*c* present yet additional arrangements. An arrangement of five square magnets is presented in FIG. 6*a*, such that a greater magnetic force is provided in one area of the assembly that may be useful in applications involving irregular or sloping surfaces to which a magnet may be attached. In this configuration, three magnets 328 are arranged at right angles with respect to a first axis 330, while two magnets 329 are oriented with their individual centerlines at a varying angle with respect to the axis. As previously described, tabs 350 extend from the plate 24.

By way of further example, FIG. 6*b* illustrates yet another arrangement involving two rectangular magnets and two square magnets oriented at right angles. The use of such an arrangement is contemplated when needing a specific magnetic strength one axis of orientation for a particular application. Still further, three apertures may be arranged as illustrated in FIG. 6*c* for securing three magnets. As with the previous embodiments, the apertures are modified to accommodate a change in size and shape of magnets.

With reference again to FIG. 1, the assembly 10 may be used to removably fasten the advertising sign 12 to the structure 14 such as a surface of a vehicle. In that regard, a portion of the sign as disclosed in U.S. Pat. No. 5,711,100 is herein illustrated by way of example, the entire specification and drawings for which are incorporated herein by reference. As shown in '100 patent and here in FIG. 1, the mounting assembly 10 in accordance with the present invention may be installed through use of the fastener 42 into a molded extension 60 of the advertising sign 12, with a flexible sleeve 62 interposed between the assembly and a recess 64 in a lower portion 66 of the sign 12.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and alternate embodiments are intended to be included within the scope of the appended claims.

That which is claimed is:

1. A magnet assembly for supporting a sign on a metallic structure, comprising:

a housing having a bottom wall and an upstanding sidewalls forming a cavity therefor;

a plate carried within the cavity, the plate having a plurality of apertures therein;

plural permanent magnets each positioned within one of the apertures;

a cover having a bottom wall and a downwardly sidewall, the downwardly sidewall making frictional contact with the upstanding sidewall of the housing for securing the cover thereto, wherein the cover is placed within the cavity of housing, wherein transverse movement of each magnet is limited by placement of the magnet within the corresponding aperture and longitudinal movement limited by the opposing inside surfaces of the cover and housing bottom walls;

tabs extending from a peripheral portion of the plate for making frictional contact with the cover for providing a compression fit between the cover and the housing; and wherein the housing, the plate, and the cover each include a central opening for receiving a fastener therethrough when fastening the assembly to an object, and wherein each of the plurality of apertures within the plate is offset from the central opening.

2. The assembly according to claim 1, wherein the housing and cover are cylindrical in shape.

3. The assembly according to claim 1, further comprising a plastic coating substantially covering the housing and cover outside surfaces.

4. The assembly according to claim 1, wherein at least a portion of the plate is in a spaced relation to the bottom wall of the housing.

5. A magnet assembly for supporting a sign on a metallic structure, comprising:

a housing having a bottom wall and an upstanding sidewalls forming a cavity therefor;

a plate carried within the cavity, the plate having a plurality of apertures therein and having an arcuate shape for permitting a peripheral portion thereof to contact the housing bottom wall while having an intermediate portion including the plurality of apertures spaced therefrom;

plural permanent magnets each positioned within one of the apertures;

a cover having a bottom wall and a downwardly sidewall, the downwardly sidewall making frictional contact with the upstanding sidewall of the housing for securing the cover thereto, wherein the cover is placed within the cavity of housing, wherein transverse movement of each magnet is limited by placement of the magnet within the corresponding aperture and longitudinal movement limited by the opposing inside surfaces of the cover and housing bottom walls;

and wherein the housing, the plate, and the cover each include a central opening for receiving a fastener therethrough when fastening the assembly to an object, and wherein each of the plurality of apertures within the plate is offset from the central opening.

6. A magnet assembly for supporting a sign on a metallic structure, comprising:

a housing having a bottom wall and an upstanding sidewalls forming a cavity therefor;

a plate carried within the cavity, the plate having a plurality of apertures therein;

plural permanent magnets each positioned within one of the apertures;

a cover having a bottom wall and a downwardly sidewall, the downwardly, the upstanding sidewall making frictional contact with the upstanding sidewall of the housing for securing the cover thereto, wherein the cover is placed within the cavity of housing, wherein transverse movement of each magnet is limited by placement of the magnet within the corresponding aperture and longitudinal movement limited by the opposing inside surfaces of the cover and housing bottom walls; and wherein the central portion of the cover includes a depression, and wherein a portion of the depression is at least proximate the bottom wall of the housing when the cover is secured thereto.

7. A magnet assembly for supporting a sign on a metallic structure, comprising:

a housing having a bottom wall and an upstanding sidewalls forming a cavity therefor;

a plate carried within the cavity, the plate having a plurality of apertures therein and having an arcuate shape for permitting a peripheral portion thereof to contact the housing bottom wall while having an intermediate portion including the plurality of apertures spaced therefrom;

plural permanent magnets each positioned within one of the apertures;

a cover having a bottom wall and a downwardly sidewall, the downwardly sidewall making frictional contact with the upstanding sidewall of the housing for securing the cover thereto, wherein the cover is placed within the cavity of housing, wherein transverse movement of each magnet is limited by placement of the magnet within the corresponding aperture and longitudinal movement limited by the opposing inside surfaces of the cover and housing bottom walls; and wherein the plurality of apertures comprises at least three apertures within the plate.

8. The assembly according to claim 7, wherein the cover is secured within the housing through frictional contact between a cooperating outer surface of the downwardly sidewall of the cover and an inner surface of the upstanding wall of the housing.

9. The assembly according to claim 7, wherein each magnet is selected from a group consisting of magnets having a rectangular cross section, a square cross section, and an arcuate cross section.

10. A magnet assembly for supporting a sign on a metallic structure, comprising:

a housing;

a plate carried within the housing, the plate having a plurality of apertures therein;

at least one of a permanent magnet and a magnetic substrate positioned within each of the plurality of apertures;

a cover placed within the housing;

the housing, the plate, and the cover each including a central opening for receiving a fastener therethrough when fastening the mounting assembly to an object; and wherein the plate comprises an arcuate shape for permitting a peripheral portion thereof to contact at least one of a housing wall and a cover wall while having an intermediate portion including the plurality of apertures spaced from opposing housing and cover bottom walls.

11. The assembly according to claim 10, wherein the housing comprises a cylindrical shape having a bottom wall and an upstanding sidewall forming a cavity therein, and wherein the cover comprises a cylindrical shape having a bottom wall and a downwardly sidewall, the downwardly sidewall making frictional contact with the upstanding sidewall of the housing for securing the cover thereto.

12. The assembly according to claim 11, wherein transverse movement of each magnet or substrate is limited by placement of the magnet or substrate within the aperture and longitudinal movement is limited by opposing inside surfaces of the cover and housing bottom walls.

13. The assembly according to claim 10, wherein the housing and cover are formed from a non-magnetic material.

14. The assembly according to claim 10, further comprising a plastic coating substantially covering the housing and cover.

15. The assembly according to claim 10, wherein at least a portion of the plate is in a spaced relation to a bottom wall of the housing.

16. The assembly according to claim 10, wherein the magnet is selected from a group consisting of magnets having a rectangular cross section, a square cross section, and an arcuate cross section.

17. A magnet assembly for supporting a sign on a metallic structure, comprising:

a housing;

a plate carried within the housing, the plate having a plurality of apertures therein;

at least one of a permanent magnet and a magnetic substrate positioned within each of the plurality of apertures;

a cover placed within the housing;

the housing, the plate, and the cover each include a central opening for receiving a fastener therethrough when fastening the mounting assembly to an object; and further comprising tabs extending from a peripheral portion of the plate for making frictional contact with the cover for providing a compression fit between the cover and the housing.

18. A magnet assembly for supporting a sign on a metallic structure, comprising:

a housing;

a plate carried within the housing, the plate having a plurality of apertures therein;

at least one of a permanent magnet and a magnetic substrate positioned within each of the plurality of apertures;

a cover placed within the housing;

the housing, the plate, and the cover each include a central opening for receiving a fastener therethrough when fastening the mounting assembly to an object; and wherein the central portion of the cover includes a depression, and wherein a portion of the depression contacts a bottom wall of the housing when the cover is secured thereto.

* * * * *